United States Patent [19]

Gerch

[11] Patent Number: 4,805,748

[45] Date of Patent: Feb. 21, 1989

[54] SPORTS DUFFLE BAG WITH HEIGHT EXPANSIBLE RACKET POCKET

[75] Inventor: Edward L. Gerch, Chicago, Ill.

[73] Assignee: Kingport International Corporation, Evanston, Ill.

[21] Appl. No.: 191,355

[22] Filed: May 9, 1988

Related U.S. Application Data

[63] Continuation-in-part of Ser. No. 158,901, Feb. 22, 1988, which is a continuation-in-part of Ser. No. 656,255, Oct. 1, 1984.

[51] Int. Cl.[4] ..... A45C 7/00

[52] U.S. Cl. ..... 190/103; 190/104; 190/109; D3/36; D3/74; 150/52 G; 206/315.1; 383/2

[58] Field of Search ..... 150/52 G, 144; 190/103, 190/104, 105, 109, 110; 206/315.1; D3/36, 74; 383/2

[56] References Cited

U.S. PATENT DOCUMENTS

| | | | |
|---|---|---|---|
| Re. 30,138 | 11/1979 | Cowen III | 150/52 G |
| D. 232,270 | 7/1974 | Glantz et al. | 150/52 G |
| D. 238,010 | 12/1975 | Canton | 150/52 G |
| 2,394,332 | 2/1946 | Salem . | |
| 2,577,670 | 12/1951 | Adams . | |
| 2,597,194 | 5/1952 | Sholl . | |
| 3,122,225 | 2/1964 | Ward . | |
| 3,410,376 | 11/1968 | Benzel . | |
| 3,955,609 | 5/1976 | Siegel . | |
| 4,153,093 | 5/1979 | Mahabir . | |
| 4,153,146 | 5/1979 | Patton et al. | 190/103 |
| 4,171,011 | 10/1979 | Kopin . | |
| 4,210,186 | 7/1980 | Belenson . | |
| 4,236,615 | 12/1980 | Ginat . | |
| 4,301,898 | 11/1981 | Plough et al. . | |
| 4,334,601 | 6/1982 | Davis . | |

FOREIGN PATENT DOCUMENTS

| | | |
|---|---|---|
| 2374866 | 12/1976 | France . |

*Primary Examiner*—David T. Fidei

[57] ABSTRACT

A sports duffle bag has a canvas, plastic, or leather, top opening tubular body, with a sidewall open top pocket closed by a slide fastener, and sized to snugly receive the head of a tennis racket. An opening at a top corner of the pocket permits the racket handle to project from the pocket. An expansion panel is secured in the mouth of the pocket and has two flaps connected by a slide fastener so that in the open position the flaps hang in the pocket alongside the head of the racket and in the closed position the flaps are pulled above the pocket and closed over a racket head extending above the pocket thus increasing the height of the pocket for accommodating oversized rackets.

13 Claims, 1 Drawing Sheet

FIG. 1
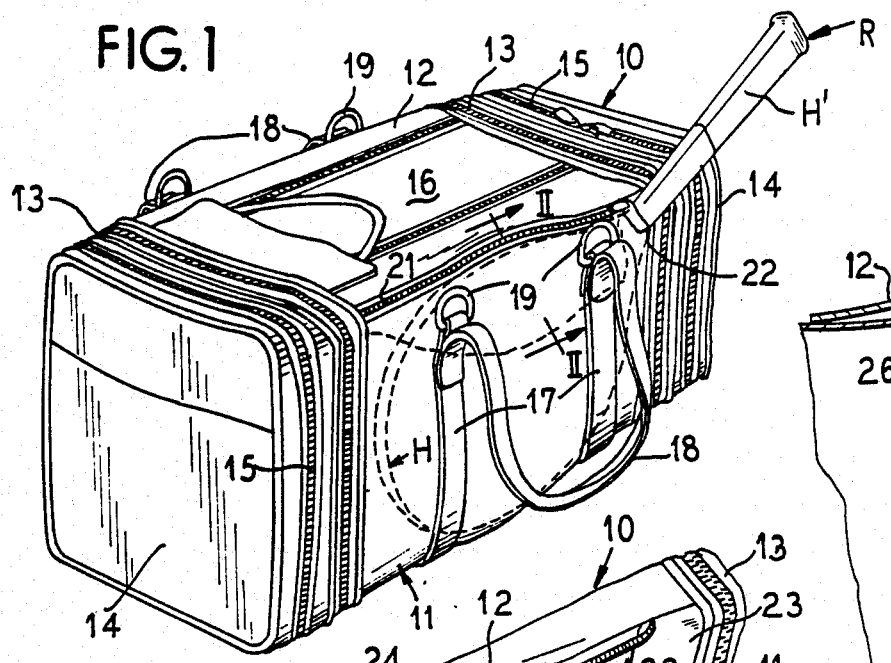
FIG. 2
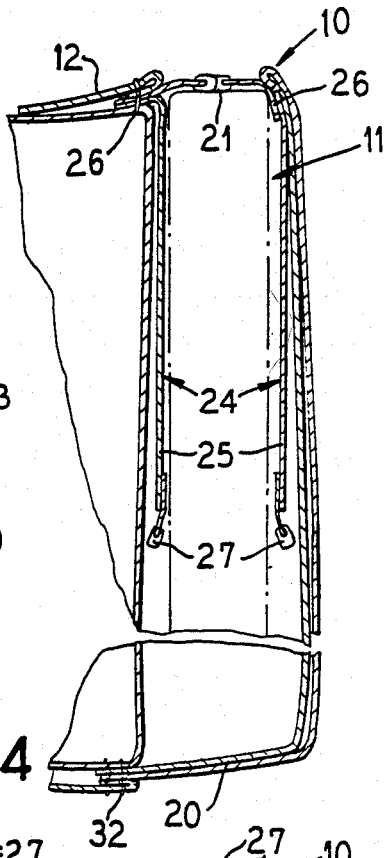
FIG. 3
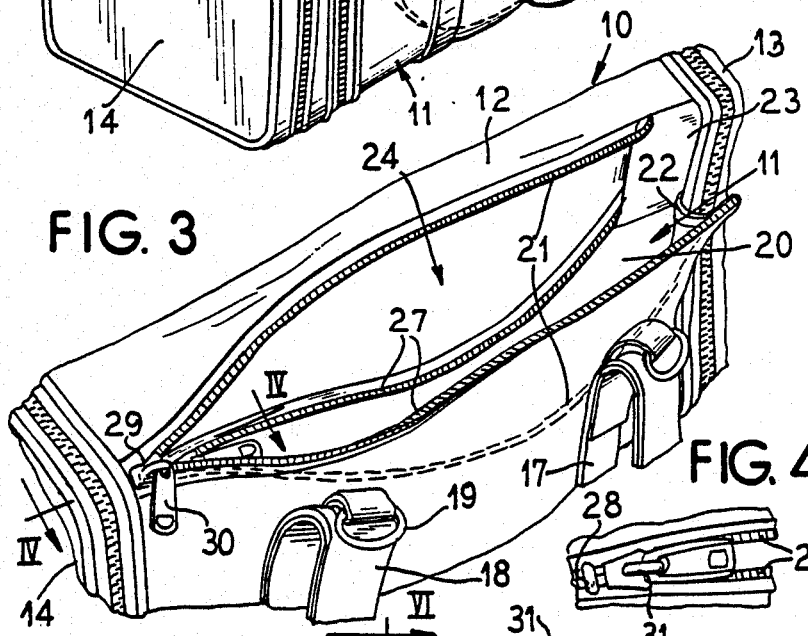
FIG. 4
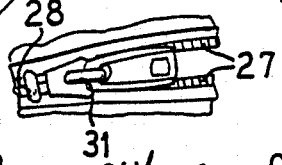
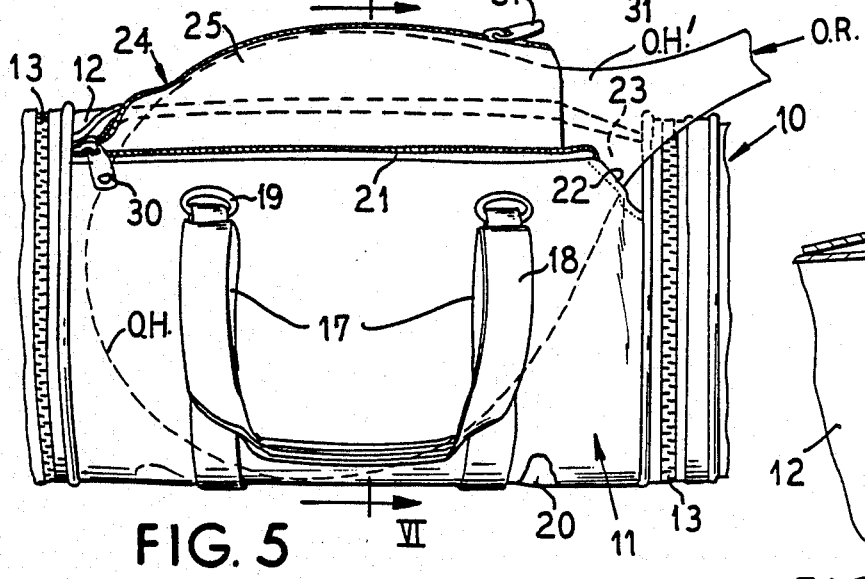
FIG. 5
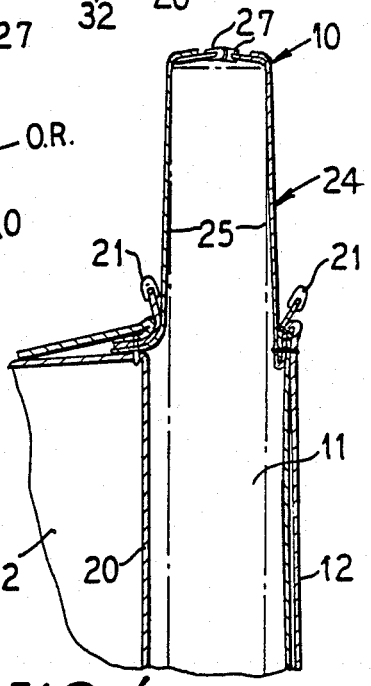
FIG. 6

SPORTS DUFFLE BAG WITH HEIGHT EXPANSIBLE RACKET POCKET

BACKGROUND OF THE INVENTION

1. Related Applications

This application is a continuation-in-part of the Edward L. Gerch and Warner D. Rosenfeld U.S. patent application entitled "Duffle Type Sports Bag", Ser. No. 158,901, filed Feb. 22, 1988, which earlier application is a continuation-in-part of the Edward L. Gerch U.S. patent application Ser. No. 656,255, filed Oct. 1, 1984, entitled "Improvement In Duffle Type Sports Bag".

2. Field of the Invention

This invention relates to improvements in sports duffle bags having side pockets snugly receiving the heads of tennis rackets wherein the pockets are expansible to accommodate the heads of oversized tennis rackets without increasing the dimensions of the bag. Specifically this invention provides a sports duffle bag having a canvas, plastic, or leather tubular body with a vertical sidewall carrying a top opening slide fastener closed sports racket receiving pocket which is expanded in height to accommodate oversized rackets.

3. Prior Art

While handbags, travel bags and the like have heretofore been provided with side or end pouches that can be pressed flatly against the bag when empty and pulled away from the bag to open up a compartment to be filled, these prior known arrangements did not provide pockets capable of snugly embracing and covering the head of a conventional sized sports racket and then expanded to snugly envelop and cover the head of an oversized sports racket without increasing the width of the pocket or the size of the bag containing the pocket.

This invention now improves the art of sports duffle bags by providing an expansion panel in the tennis racket receiving pocket on the side of the bag which, when needed, can be pulled above the pocket to extend its height.

SUMMARY OF THE INVENTION

I have found that the tennis racket receiving side pockets of sports duffle bags such as disclosed in the parent patent applications Ser. Nos. 158,901 and 656,255, above identified, could not be closed over the heads of oversized tennis rackets because such heads extended above the pockets. I also found that it was not practical to increase the height of the pocket to accommodate larger sized rackets since this would require enlarging the height of the bag and would then leave the regular sized racket heads loose and free to shift in the pocket to the annoyance of the bag carrier and also exposing the racket to damage as it shifted in the pocket.

This invention, therefore, maintains a tight snug fit for tennis racket heads of different sizes in the side pocket of a duffle or traveling bag by providing an expansion panel for the pocket which does not interfere with the snug fitting of a conventional sized tennis racket but which is easily pulled above the pocket to expand its size for the snug fitting of an oversized tennis racket.

The pocket is an open top bag of flexible waterproof fabric covered on its outer face by a sidewall of the duffle bag body. It has a size snugly receiving the head of a conventional size tennis racket and is closed at its top by a slide fastener. A top end corner of the pocket has an opening through which the handle of the tennis racket projects and when the slide fastener closes the pocket, the head of the racket fits snugly in the pocket with the handle projecting therefrom at an upwardly inclined angle.

The expansion panel is composed of the same waterproof fabric as the bag of the pocket and has two flaps secured along their lengths around the mouth of the bag underlying the slide fastener. These flaps have free ends along their lengths each carrying a slide fastener track tape and the two tracks are connected at their ends remote from the corner opening by a slide stop. The slide thus travels on the tracks from the corner opening to the stop to separate the flaps and from the stop to the corner opening to connect the flaps. When the slide is at the stop ends of the tracks, the flaps hang down inside the bag along its sides below the slide fastener for the pocket and do not form an obstruction for the racket head so that the slide fastener for the pocket can be closed over this head. Then, when the flaps are pulled out of the bag to cover the head of an oversized racket, they are connected together by pulling the slide to the corner opening. This snugly covers the head in the expanded pocket.

The attached drawings show a best mode embodiment of the invention in which:

FIG. 1 is a perspective view of a sports duffle bag with a side pocket closed over the head of a conventional tennis racket.

FIG. 2 is a fragmentary and broken transverse cross sectional view along the line II—II of FIG. 1.

FIG. 3 is a perspective view of a portion of a sports bag of FIG. 1 showing the side pocket in open position.

FIG. 4 is a fragmentary plan view underlying the top of the pocket and taken generally along the line IV—IV of FIG. 3.

FIG. 5 is a fragmentary side elevational view of the bag of FIGS. 1–3 showing the pocket in its expanded condition closed over the head of an oversized tennis racket.

FIG. 6 is a fragmentary vertical sectional view along the line VI—VI of FIG. 5.

DETAILED DESCRIPTION OF THE PREFERRED EMBODIMENT

The reference numeral 10 of FIGS. 1 - 3, 5 and 6 illustrates generally a sports duffle bag with a height extensible tennis racket receiving side pocket 11. The bag 10 is preferably composed of a tubular main body 12 with vertical sidewalls, horizontal top and bottom walls and end expansion panels closed by slide fasteners 13. These expansion panels (not shown) have end compartments closed by end lids 14,14. Slide fasteners 15,15 secure the lids to the outer ends of the expansion panels. A slide fastener panel 16 on the top of the body 12 gives access to the interior of the body.

Straps 17 around the bottom and sides of the body 12 have U-shaped handles 18 secured thereto and carry fastener rings 19 for selectively receiving the ends of a shoulder carrying strap (not shown).

The bag 10 is preferably composed of a waterproof fabric, such as canvas, leather, or a flexible plastics material.

The side pocket 11 is composed of a bag 20 of waterproof fabric material and is suspended from the top of the bag along one vertical sidewall of the body as illustrated in FIG. 2. The open top of the bag 20 is closed by a slide fastener 21. The bag 20 preferably extends the full height and length of the sidewall of the main body 12.

The top right end corner of the outer face of the bag 20 is inclined downward at about a 45 degree angle beyond the runs of the slide fasteners 21. The inclined edge of the bag is covered with a hem 22 of the same material as the body 12. A tab 23 of the body 12 is secured over the corner of the bag opposite the hem. The hem 22 and tab 23 define the mouth of a top corner opening of the bag 20.

An expansion panel 24 is suspended in the mouth of the bag 20 and is composed of a pair of flaps 25 of the same material as the bag 20 stitched to the mouth of the bag as illustrated at 26 in FIG. 2 beneath the slide fastener 21 so that in their free state, as shown in FIG. 2, these flaps lie adjacent the sidewalls of the bag 20 and extend the full length of the bag. The free ends of the flaps have slide fastener tracks 27 along their length connected at the ends thereof remote from the open corner 23 by a stop 28 which is under a similar stop 29 for the tracks of the slide fastener 21. The slide 30 for the fastener tracks 21 and the slide 31 for the fastener tracks 27 travel from their stops 28 and 29 to the ends of their respective tracks at the top of the open corner 22.

The inner sidewall of the bag 20 is secured at its bottom to the bottom of the tubular body 12, as illustrated at 32 in FIG. 2, so that the bag does not swing away from the overlapping sidewall of the body.

With the flaps 25 of the expansion panel 24 in their suspended open position as shown in FIG. 2, and with the slide fastener 21 of the bag 20 in open position, a conventional sized tennis racket R, as shown in FIG. 1, has its head H snugly seated in the bag and with its handle H' projecting through the top corner opening in the upper right hand corner of the pocket 11. Then, when the slide fastener 21 is pulled to its pocket closing position, the racket head H is snugly enclosed and sealed in the pocket while the neck portion of the handle H is snugly embraced by the tab 23 and the hem 22. The racket R is thus firmly seated in position on the sidewall of the bag 12 with its head fully protected from the elements.

As shown in FIGS. 5 and 6 the height of the side pocket 11 is expanded by pulling the flaps 25 of the expansion panel 24 through the open top of the bag 20. The height of the pocket 11 is thus expanded above the top of the main bag 12 to accommodate an oversized tennis racket O.R. with an oversized head O.H. seated in the bag 20 and extending thereabove between the flaps 25. Then, when the slide 31 is pulled to the ends of its tracks 27 above the top corner opening, the wider oversized handle O.H. of the racket O.R. will fit snugly through the extended corner opening and the oversized racket will be snugly carried in the same manner on the side of the duffle bag as the conventional racket. The expansion panel 24 snugly embraces the sides and top of the racket head projecting beyond the bag 20 to snugly receive and seal the racket head in the side pocket.

From the above explanations it should be clearly understood that this invention provides a side pocket arrangement for sports duffle bags which is easily expanded in height to accommodate oversized tennis rackets without increasing the size of the bag.

I claim as my invention:

1. A sports duffle bag which comprises a top opening tubular body having vertical side walls, a top opening slide fastener closed pocket on one of the sidewalls adapted to receive the head of a tennis racket or the like and having a top corner opening permitting the racket handle to project from the pocket in an upwardly inclined direction, a height expansion panel for said pocket having a pair of flaps suspended from the mouth of the top opening of the pocket below the slide fastener and a second slide fastener connecting the flaps along their lengths whereby the panel can be pulled above the pocket to increase the pocket height and the second fastener pulled into closed position above the corner opening to encase and seal the oversized head of an oversized tennis racket in the expanded pocket with the handle projecting through the same corner opening.

2. A sports duffle bag which comprises a pliable tubular body having flat top, bottom and sidewalls closed at the ends by compartments with end flaps, one of said flat sidewalls having a top opening side pocket suspended in the body alongside the sidewall with an open mouth on the top wall of the bag closed by a slide fastener, an expansion panel suspended in the mouth of the pocket below the slide fastener having separated side flaps in the pocket adapted to be pulled through the mouth of the pocket to an extended position above the pocket, and a second slide fastener conecting said flaps to extend the height of the pocket above the top of the bag.

3. In a sports duffle bag having a side pocket adapted to receive the head of a tennis racket provided with an opening through which the handle of the racket projects, the improvement of an expansion panel for said pocket composed of slide fastener connected flaps adapted to depend in their open position into the pocket and to be pulled above the pocket and closed around the oversized head of a tennis racket whereby conventional sized and oversized tennis rackets can have their heads snugly sealed in the pocket.

4. The bag of claim 1 wherein the pocket is a fabric bag inside the tubular body suspended from the top of the body adjacent said one sidewall.

5. The bag of claim 4 wherein the fabric bag has an open top with a mouth secured to the top of the body and a closed bottom secured to the bottom of the body.

6. The bag of claim 1 wherein the top corner opening is defined by a tab of the body and an inclined hem of the pocket.

7. The bag of claim 1 wherein the flaps are connected at one end by a stop for the slide fastener.

8. The bag of claim 7 wherein the opposite ends of the flaps are separated beyond the fastener to extend the corner opening of the pocket when the panel is pulled above the pocket.

9. The bag of claim 2 wherein the second slide fastener terminates inwardly from the first slide fastener.

10. The bag of claim 2 wherein the side pocket is a bag inside the body.

11. The bag of claim 2 wherein the pocket and panel have top corner openings.

12. The bag of claim 3 wherein the side pocket is a fabric bag and the expansion panel is formed of the same fabric material.

13. The bag of claim 3 wherein the expansion panel has an opening extending the opening of the pocket.

* * * * *